US008286792B2

(12) United States Patent
Serpico et al.

(10) Patent No.: US 8,286,792 B2
(45) Date of Patent: Oct. 16, 2012

(54) ROUTER BIT KIT

(75) Inventors: Joseph Serpico, Aurora, IL (US); Randy Rosebrook, Grayslake, IL (US); Wade Nachtigall, Chicago, IL (US)

(73) Assignee: Robert Bosch GmbH, Stuttgart (DE)

( * ) Notice: Subject to any disclaimer, the term of this patent is extended or adjusted under 35 U.S.C. 154(b) by 466 days.

(21) Appl. No.: 12/220,643

(22) Filed: Jul. 25, 2008

(65) Prior Publication Data

US 2009/0050501 A1 Feb. 26, 2009

Related U.S. Application Data

(60) Provisional application No. 60/962,329, filed on Jul. 27, 2007.

(51) Int. Cl.
*B65D 85/28* (2006.01)

(52) U.S. Cl. ..... 206/379; 206/486

(58) Field of Classification Search ..... 206/379, 206/372, 374, 375, 376, 377, 378, 493, 229, 206/230, 373, 486
See application file for complete search history.

(56) References Cited

U.S. PATENT DOCUMENTS 3,703,234 A 11/1972 Howard
5,443,310 A 8/1995 DeFelice et al.
5,562,208 A * 10/1996 Hasler et al. ..... 206/373
5,755,323 A 5/1998 Zahn et al.
5,813,532 A 9/1998 Kheradpir et al.
6,152,299 A * 11/2000 O'Malley et al. ..... 206/349
6,854,607 B2 * 2/2005 Tong ..... 211/70.6
2006/0186007 A1 * 8/2006 Dost et al. ..... 206/379
2006/0283769 A1 * 12/2006 Roesler ..... 206/588

OTHER PUBLICATIONS

'Wood magazine' <http://www.woodstore.net/is17oc20.html> Oct. 2006.*

Wood Tech Tooling web site page "*CMT Router Bit Sets with Wooden Cases*" www.woodtechtooling.com; published at least as early as Apr. 2, 2007; (5 pages).

Tools Today web site p. "*1/4 Shank by Timberline*", www.toolstoday.com; published at least as early as Apr. 2, 2007; (2 pages).

* cited by examiner

*Primary Examiner* — J. Gregory Pickett
*Assistant Examiner* — Robert Poon
(74) *Attorney, Agent, or Firm* — Maginot, Moore & Beck

(57) ABSTRACT

A router bit kit includes a plurality of router bits, a plurality of router bit holders and a container. Each of the plurality of router bits has a cutting surface configured to produce a cut having a three dimensional kerf profile. Each of the plurality of bit holders corresponds to at least one of the plurality of f router bits. Each of the plurality of bit holders has a three dimensional kerf profile portion that matches the three dimensional kerf profile which the corresponding router bit is configured to produce. The container is configured to retain the plurality of router bits and the plurality of holders.

7 Claims, 8 Drawing Sheets

ROUTER BIT KIT

CROSS REFERENCE TO RELATED APPLICATIONS

This application is a Utility Patent Application of Provisional Patent Application U.S. Patent Application No. 60/962,329 titled "ROUTER BIT KIT" filed Jul. 27, 2007. This application claims priority of Provisional Patent Application U.S. Patent Application No. 60/962,329 titled "ROUTER BIT KIT" filed Jul. 27, 2007. U.S. Patent Application No. 60/962,329 is hereby incorporated by reference herein in its entirety.

FIELD OF THE DISCLOSURE

The present disclosure relates to router bits that are used in routers to machine features into materials.

BACKGROUND OF THE DISCLOSURE

Routers are used for a variety of woodworking purposes including finishing work for furniture and cabinets as well as functional connections made of complimentary shaped profiles such as tongue and groove joints, etc. Routers typically comprise a pneumatic or electric motor that is located in a housing axially moveably connected to a base by mating threads on the housing and base. Routers include a router bit that is attached to the router by a chuck or collet. The collet extends from a shaft of the motor and is positioned perpendicular to a face of the base such that the surface of the base is translated along a surface of the work piece with the bit extending from the face to perform the work on the work piece. To adjust the depth of the cut, the housing is rotated relative to the base which moves the bit axially relative to the base. The bit may include a pilot that rides against a shoulder of the workpiece to control the cut.

When a work piece is cut with a bit of the router, a shape is provided in the work piece that is complimentary to the shape of the router bit. This shape cut by the router bit into the furniture or other work piece is three dimensional and made by rotating the router bit as the router is moved relative to the work-piece. The three dimensional shape that a router bit is configured to cut or otherwise impart to a workpiece may be referred to herein as a "kerf profile". The router bit includes one or more cutting edges or surfaces that are configured to cut the kerf profile in a workpiece.

To prepare different work-piece shapes, such as shapes in a wood furniture product, differently shaped router bits are needed. However, the shape that the router bit imparts to the work piece may be difficult for a user to visualize before the bit is used to make a cut. When a user has the choice of several different router bits, it may be difficult for the user to identify the particular bit required to make the desired shape. Accordingly, it would be desirable to provide a product that would assist the user in choosing an appropriate router bit for a desired kerf profile.

Damage to a router bit, including damage to the shaft or cutting edges or surfaces, can result in a bit that does not provide a proper cut Thus, router bits should be protected when not in use. Accordingly, the router bits are often stored in containers that provide protection for the router bits. Router bits containers are available with separate locations or pockets for each bit. Router bits are often sold as kits which include such a container capable of holding multiple bits. In view of the foregoing, it would be advantageous to provide a router bit kit that provides improved visualization of each router bit and the cut performed by such router bit. It would also be advantageous for such router bit kit to provide for easy access to the bits and organized display and presentation of the bits.

SUMMARY OF THE DISCLOSURE

In accordance with one embodiment, there is provided a router bit kit including a plurality of router bits, a plurality of bit holders, and a container. Each of the plurality of router bits has a cutting surface configured to produce a cut having a three dimensional kerf profile. Each of the plurality of bit holders corresponds to at least one of the plurality of router bits. Each of the plurality of bit holders has a three dimensional kerf profile portion that matches the three dimensional kerf profile which the corresponding router bit is configured to produce The container is configured to retain the plurality of router bits and the plurality of holders.

According to another embodiment, there is provided a router bit kit including a router bit and a bit holder. The router bit has a cutting surface configured to produce a cut having a three dimensional kerf profile. The bit holder has a three dimensional kerf profile portion that corresponds to the cut the router bit is configured to make.

Pursuant to another embodiment, there is provided a router bit kit. The kit includes a plurality of router bits. Each of the plurality of router bits has a cutting surface configured to produce a cut having a three dimensional kerf profile. The kit also includes a plurality of bit holders. Each of the plurality of bit holders corresponds to at least one of the plurality of router bits. Each of the plurality of bit holders has a three dimensional kerf profile portion that matches the three dimensional kerf profile which the corresponding router bit is configured to produce. Each of the plurality of bit holders defines a cavity configured to receive at least a portion of the corresponding router bit.

BRIEF DESCRIPTION OF THE DRAWINGS

The accompanying drawings illustrate various embodiments of the present disclosure and together with a description serve to explain the principles of the disclosure.

In the drawings.

Corresponding reference characters indicate corresponding parts throughout the several views. Like reference characters indicate like parts throughout the several views.

DETAIL DESCRIPTION OF THE DISCLOSURE

Figure 1:
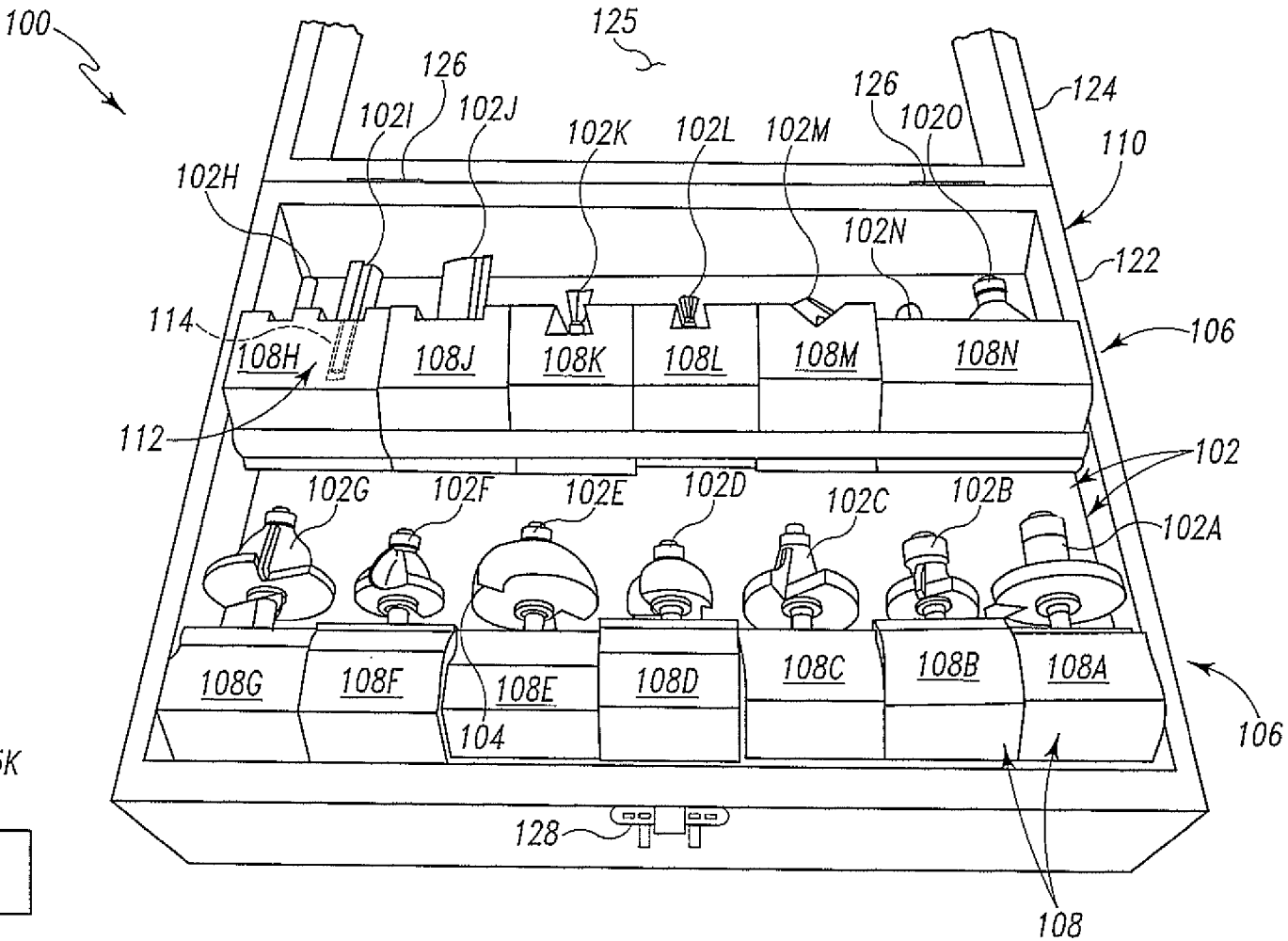
FIG. 1 is a partial front perspective view of a router bit kit.

While the router bit kit described herein is susceptible to various modifications and alternative forms, specific embodiments thereof have been shown by way of example in the drawings and will herein be described in detail. It should be understood, however, that there is no intent to limit the router bit kit to the particular forms disclosed. On the contrary, the intention is to cover all modifications, equivalents, and alternatives falling within the spirit and scope of the invention as defined by the appended claims.

Referring now to FIG. 1, a router bit kit 100 according to the present disclosure is shown. The router bit kit 100 includes a plurality of router bits 102, with each of the bits 102 stored in a bit holder 108. The bit holders 108 fit into a container 110. Each of the router bits 102 has a surface 104 configured to produce a cut having a three dimensional kerf profile.

Figure 1A:
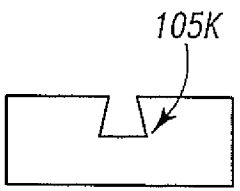
FIG. 1A is a plan view of a work piece cut with an internal router bit of the router bit kit of FIG. 1.

For example, the router bit kit 100 includes a plurality of router bits 102. Each of the plurality of router bits 102A-102O is seated in a bit holder 108. The plurality of router bits 102A-102O and the associated bit holders 108A-108N are positioned in a container 110. For example and as shown in FIG. 1A, a kerf profile 105K is shown prepared by, for example, router bit 102K.

As shown in FIG. 1, the router bit kit includes a plurality of bit holders 108. Each of the plurality of bit holders 108 corresponds to at least one of the plurality of router bits 102. Each of the plurality of bit holders 108 has a three dimensional kerf profile portion 106 that corresponds to the bit held by the bit holder. In other words, an example of the particular cut that a particular bit is designed to make is cut, formed, or otherwise provided in the bit holder designed to hold the particular bit.

The router bit kit 100 of this embodiment of the present disclosure may include any plural number of router bits and bit holders. For example and as shown in FIG. 1, The router bit kit 100 includes fifteen router bits 102 and thirteen bit holders 108. For simplicity, the number of router bits and the number of bit holders may correspond on a one to one relationship. However, bit holders do not necessarily need to have a one to one correspondence to router bits. In other words, a single bit holder may hold more than one router bit.

As shown in FIG. 1, the plurality of router bits 102 of kit 100 include a first router bit 102A, a second router bit 102B, a third router bit 102C, a fourth router bit 102D, a fifth router bit 102E, a sixth router bit 102F, a seventh router bit 102G, an eighth router bit 102H, a ninth router bit 102I, a tenth router bit 102J, an eleventh router bit 102K, a twelfth router bit 102L, a thirteenth router bit 102M, a fourteenth router bit 102N, and a fifteenth router bit 102O. Correspondingly, the plurality of bit holders 108 of kit 100 include a first bit holder 10A, a second bit holder 102B, a third bit holder 102C, a fourth bit holder 102D, a fifth bit holder 102E, a sixth bit holder 102F, a seventh bit holder 102G, an eighth bit holder 102H, a ninth bit holder 102J, a tenth bit holder 102K, an eleventh bit holder 102L, a twelfth bit holder 102M, and a thirteenth bit holder 102N.

Some of the router bits 102 have individual holders 108. For example, the third router bit 102C has an individual holder 108C. Alternatively, some of the router bits 102 share a common bit holder 108. For example, router bit 102H and router bit 102I are held by a common router bit holder 108H. Similarly, the router bit 102N and the router bit 102O are held by the bit holder 108N.

As set forth above, the router bit kit, as shown in FIG. 1, may further include a container 110 for retaining the plurality of router bits 102 and the plurality of bit holders 108. As shown in FIG. 1, each of plurality of bit holders 108 may include a seat or other holding feature for receiving at least one of the router bits 102. For example, the holding feature may be in the form of a cavity 112. The cavity 112 is configured to receive a portion of the corresponding router bit 102, for example stem 114. The cavity itself may provide the seat for the bit holder or may be configured to receive another seat component, such as a plastic cylinder which receives the stem of the bit holder.

Figure 2:
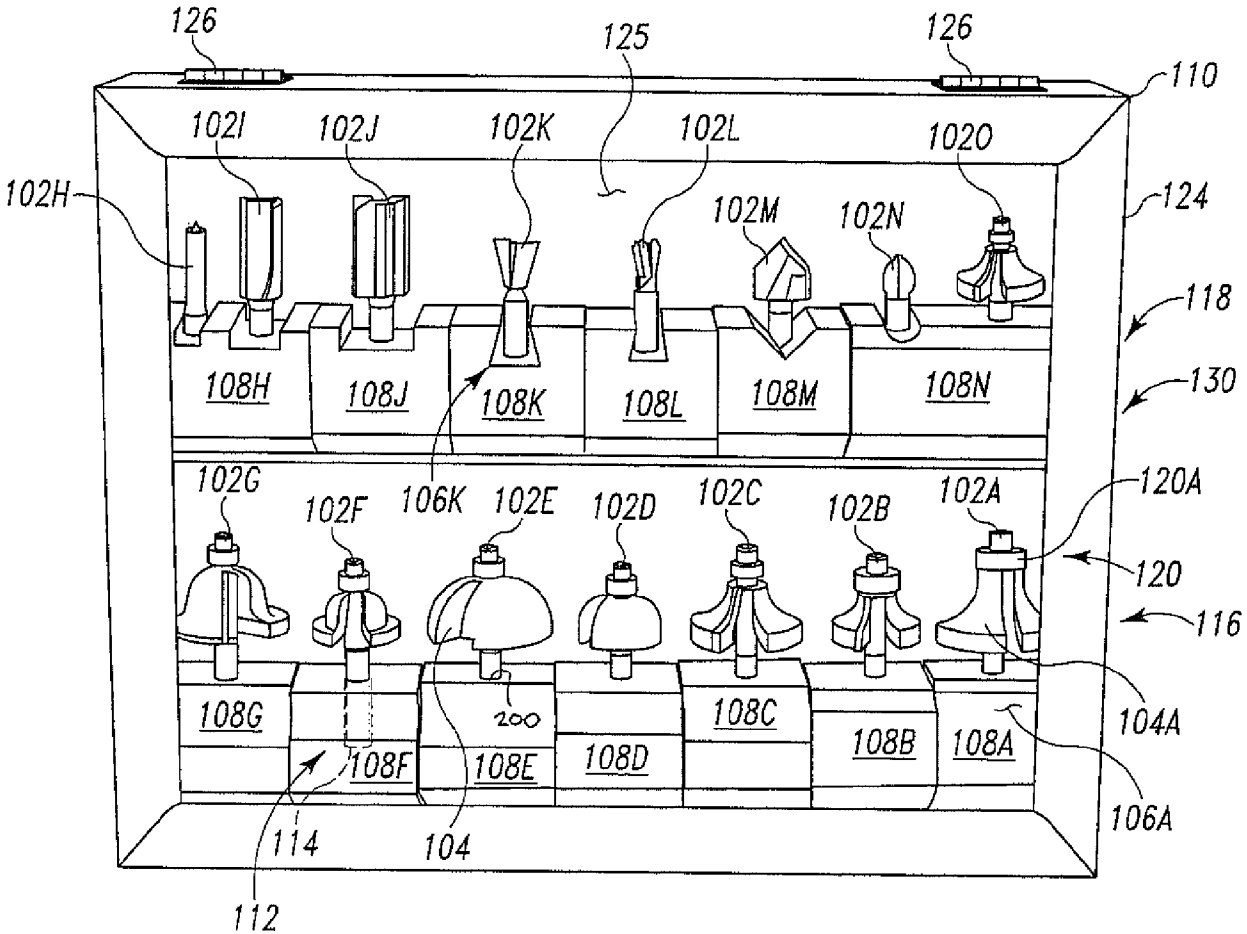
FIG. 2 is a front perspective view of the router bit kit of FIG. 1 with the lid of the container closed.

Referring now to FIG. 2, each of the router bits 102 has a cutting surface 104 that provides a complimentary shape to a work piece. Typically the router bits 102 include external profile router bits 116 and internal profile router bits 118. The external profile router bits 116 are configured to cut external three dimensional kerf profiles in a corner portion of a work piece. Examples of external three dimensional kerf profiles include chamfer cuts, cove cuts, rabbeting cuts, round over cuts, and beading cuts. The external profile router bits 116 may include a pilot 120 for positioning against the external profile of the work piece. For example, as shown in FIG. 2, the router bit 102A includes cylindrical pilot 120A.

Internal profile router bits are configured to cut internal three-dimensional kerf profiles that define a slot in a surface of the work piece. Examples of internal three dimensional kerf profiles include v-groove cuts, round nose cuts, dado cuts and dovetail cuts. For example, as shown in FIG. 2, internal profile router bit 102K cuts an internal three dimensional profile in the form of a slot, The bit holder 108K includes a three dimensional profile portion in the form of slot 106K that matches the slot cut by the router bit 102K.

To perform a cut in a work piece, a router bit is connected to a collet or chuck of a router. The router includes a base that is threadably secured to the router. The base includes a face normal to the bit to serve as a guide during cutting. By adjusting the base relative to the router bit, the router bit may be used to cut at different depths. Accordingly, different shapes may be cut with the same router bit. Thus, it should be appreciated that a bit holder may be provided with more than one three dimensional profile portion, each of the profile portions corresponding to a cut with a different router bit cutting depth of the same router bit.

The router bits 102 may be made of any suitable durable material and are typically made of a metal. If made of a metal, the router bits 102 may be made of a carbide steel or include a cutting surface portion made of carbide steel. The bit holders 108 may be made of any suitable durable material. For example, the bit holders 108 may be made of a polymer, a synthetic rubber, or wood. The fabrication of the bit holder 108 from wood has an advantage of illustrating the texture of a wooden work piece cut by that particular router bit. The bit holder 108 may be cut by the particular router bit to which it is associated or by a router bit having a cutting surface with a shape similar to the router bit 102. If made of polymer or synthetic rubber, the bit holder may be molded.

Referring again to FIG. 1, the router bit kit 100 is shown with the plurality of router bits 102, for example, router bits 102A through 102N. Each router bit 102 is positioned in one of the bit holders 108, for example bit holder 108A through 108O. The router bits 102 and the bit holders 108 are fitted into container 110. The container 110 has a size and shape capable of containing the plurality of router bits 102 and the plurality of bit holders 108. For simplicity and as shown in FIGS. 1, the container 110 is rectangular and includes a base 122 and a lid 124 pivotally secured by hinges 126 to the base 122. A latch 128 may be utilized to secure the lid 124 to the base 122.

The container 110 may be made of any suitable durable materials, for example, metal, cardboard, plastic or wood, or a combination of these materials. For example, the base 122 and the lid 124 may be made of wood and the hinges 126 and the latch 128 may be made of metal, The container may include a transparent panel 126 for viewing the bits 102 and the holders 108 when the lid 124 is closed. The panel 125 may be made of glass or a polymer.

Figure 3:
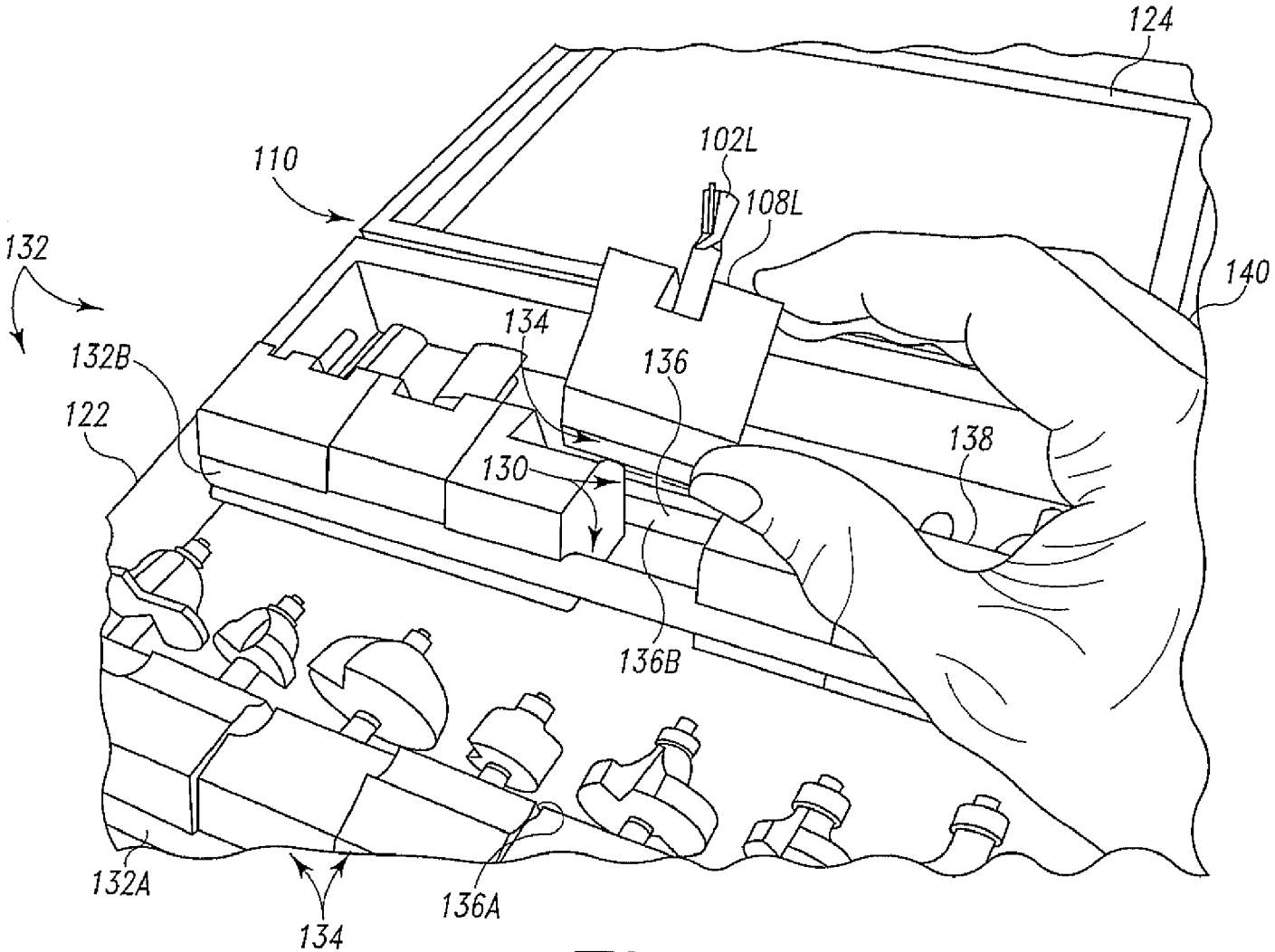
FIG. 3 is another partial front perspective view of the router bit kit of FIG. 1 with one of the router bits positioned in one of the bit holders being removed from the container of the router bit kit.
Figure 4:
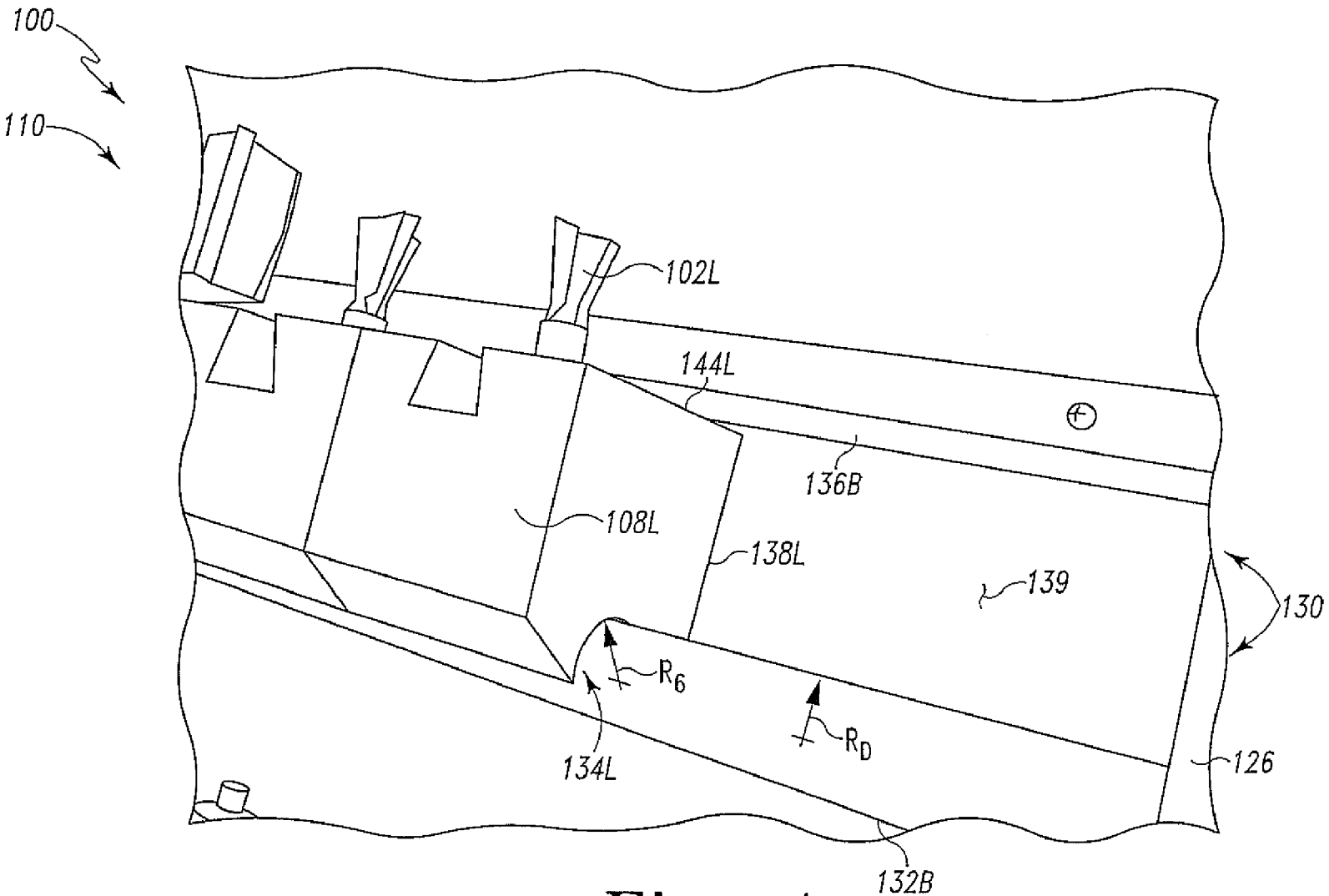
FIG. 4 is another front perspective view of the router bit kit of FIG. 1 with some of the router bits and router bit holders removed to expose the bit holder engaging portion of the container.

Referring now to FIGS. 3 and 4, the container 110 includes a bit holder engaging portion 130 in the form of a dowel 132 or other rod configured to engage a groove 134 formed in the bit holders 108. The bit holder engaging portion 130 may further include a backer piece 136 such as a bar or other trapping component that cooperates with the top portions 144 of the bit holders 108. As set forth in further detail below, bit holder engaging portion 130 cooperates with the bit holders 108 to provide a mating fit of the bit holders 108 to the container 110. The bit holders 108 may optionally snap into the bit holder engaging portion 130 of the container 110.

In the embodiment of FIGS. 3 and 4, the container 110 includes a first dowel 132A and a second dowel 132B. The container 110 further includes a corresponding first backer piece 436A and a corresponding second backer piece 136B. It should be appreciated that a solitary dowel and back piece or three or more dowels and backer pieces may be utilized. Other suitable engaging portions 130 may be utilized to contain the bit holders 108 within the container 110. For example, the holders and the container may include latches, depressions, tabs, cavities, protrusions, or other features to provide mating cooperation of the holders to the container 110.

In order to place one of the bit holders 108 and associated bits 102 in the container 110, such as bit holder 108L and bit 102L, the bit holder 108L is held in a hand of an operator 140 and positioned near the container 110. As can be seen, the bit holder 108L is held by the fingers of the operator 140 and lowered into position against the dowel 132B and the backer piece 136B. In particular, the user first brings groove 134L into engagement with the dowel 132B. The user then rotates the bit holder 108L around the dowel 132B such that the top portion 144L moves toward the backer piece 136B and eventually under the backer piece 136B. To this end, the rear of the top portion 144L may be curved to allow the top portion 144L to easily slide under the backer piece. With the bit holder 108L in this position, the bit holder 108L is trapped in place in the container 110 between the dowel 132B and the backer piece 136B. In order to remove the bit holder 108L from the container 110, the user simply grasps the bit holder and rotates the bit holder 108L outward. Once the top portion 144L of the bit holder 108L clears the backer piece 136B, the bit holder may be removed from engagement with the dowel 132B and removed from the container 110. It should be appreciated that a snap-in feature could be easily added to the bit holders in the form of a protrusion, a tab, a detent or other feature (not shown) on the rear of the top portion to mate with the backer piece.

Referring now to FIG. 4, the bit holder 108L holding the router bit 102L is shown in position in the container 110. Groove 134L is aligned with the dowel 132B. The groove 134L has a radius $R_G$ that is similar to $R_D$ of the dowel 132B. The bit holder 108L includes back 138L that mates with bottom 139 of the container 110 and a top 144L that mates with backer piece 136B.

Figure 5:
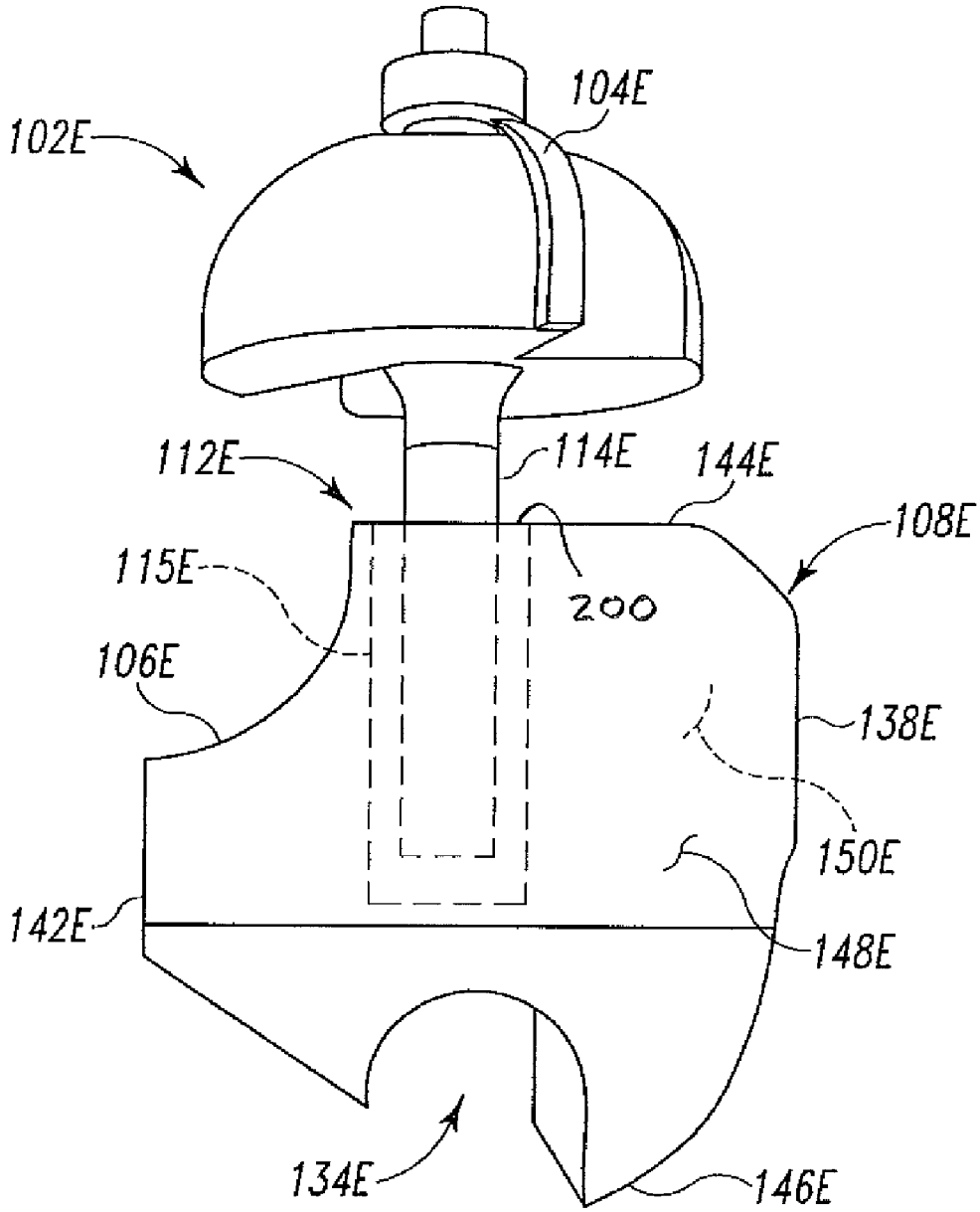
FIG. 5 is a side perspective view of an external router bit of the router bit kit of FIG. 1 positioned in a bit holder of the router bit kit of FIG. 1.

Referring now to FIG. 5, external router bit 102E is shown with its stem 114E extending through an access opening 200 and into the cavity 112E of the bit holder 108E. The router bit 102E includes a cutting surface 104E which is configured to provide a cut having a three dimension kerf profile. The bit holder 102E includes the three dimensional kerf profile portion 106E formed on the outer periphery of the bit holder 108E.

The bit holder 108E, as well as the other bit holders 108, may have any suitable shape. For simplicity and as shown in FIGS. 1-5, the bit holder 108 may have a generally rectangular shape. For example holder 108E of FIG. 5 includes a back 138E, a front 142E, a top 144E, and a bottom 146E. Groove 134E is formed in the bottom 146E. The router bit holder 108E may further include a right face 148E and a left face 150E It should be appreciated that the bit holder 108 may have any geometrical or non-geometrical shape, For example, the bit holder may have a spherical, cylindrical, polygonal, or have any irregular shape.

While the city 112E itself may provide the seat for the bit holder 108E, as shown in FIG. 5, another seat component in the form of a cylinder 115E receives the stem 114E of the bit holder 108E. The cylinder 115E may be made of a polymer and may be secured to the bit holder 108E by interference fit or by adhesives. The cylinder 115E may be deformable or may be rigid. The cylinder 115E may have a clearance fit, mating fit or interference fit with the stem 114E. It should be appreciated that the cylinder 115E may provide a securing feature to secure the bit 102E in the holder 108E. The mating fit or interference fit may provide such a securing feature or a protrusion, a tab or another feature may be located in the cylinder to provide the securing feature.

Figure 6:
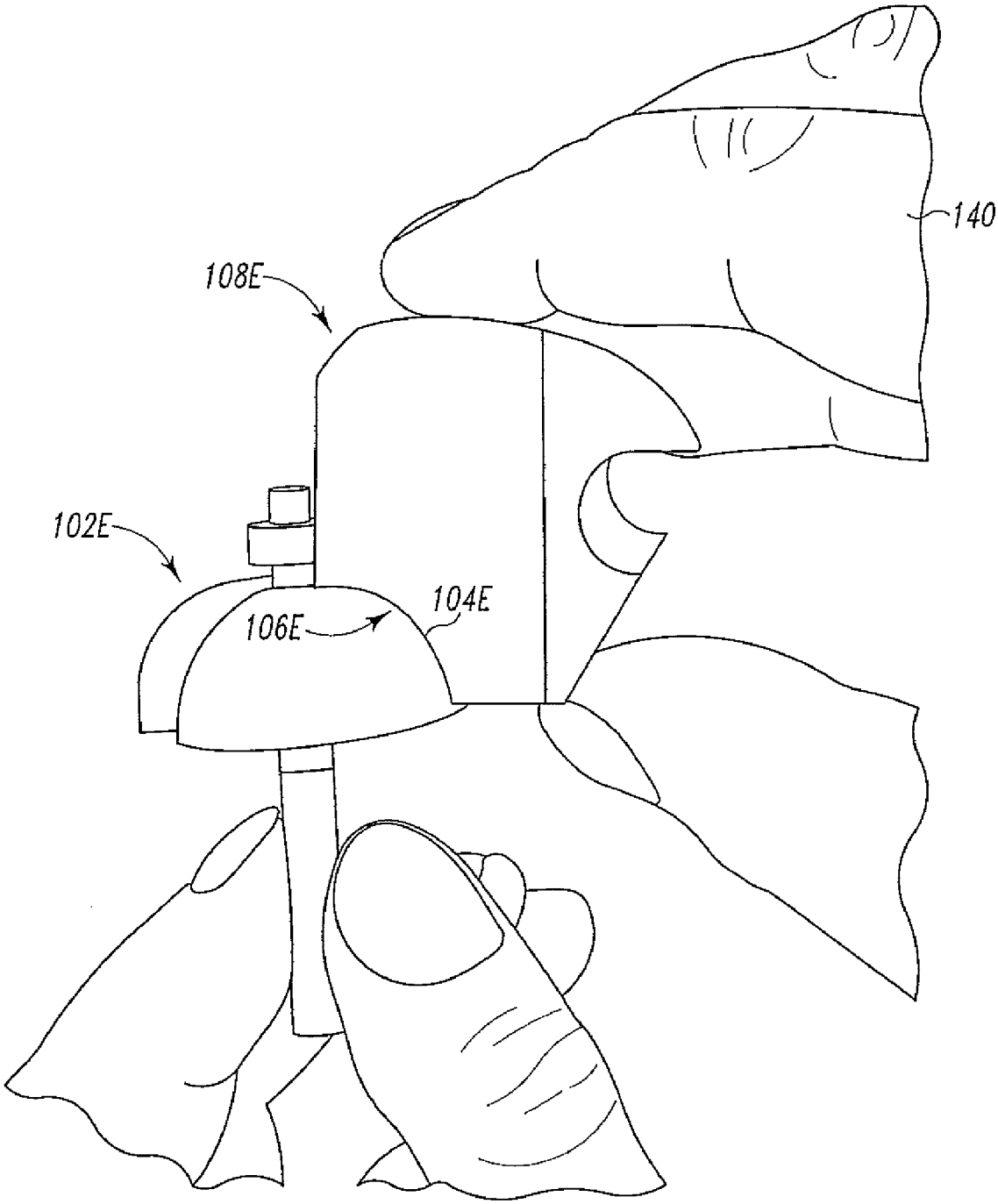
FIG. 6 is another side perspective view of the router bit of FIG. 5 being positioned against the bit holder of FIG. 5 of the router bit kit of FIG. 1.

Referring now to FIG. 6, the router bit 102E is shown removed from the bit holder 108E. When the operator 140 positions the bit holder 108E with cutting surface 104E of the bit 102E positioned against the three dimensional kerf profile surface 106E of the holder 18E, the cutting surface 104E conforms to the three dimensional kerf profile portion 106E. While the router bit 102E may or may not have been utilized to cut the three dimensional kerf profile portion 106E of the corresponding bit holder 108E, a tool similar to the router bit 102 may be utilized or another method may be used to obtain the shape of the three dimensional kerf profile portion 106E.

Figure 7:
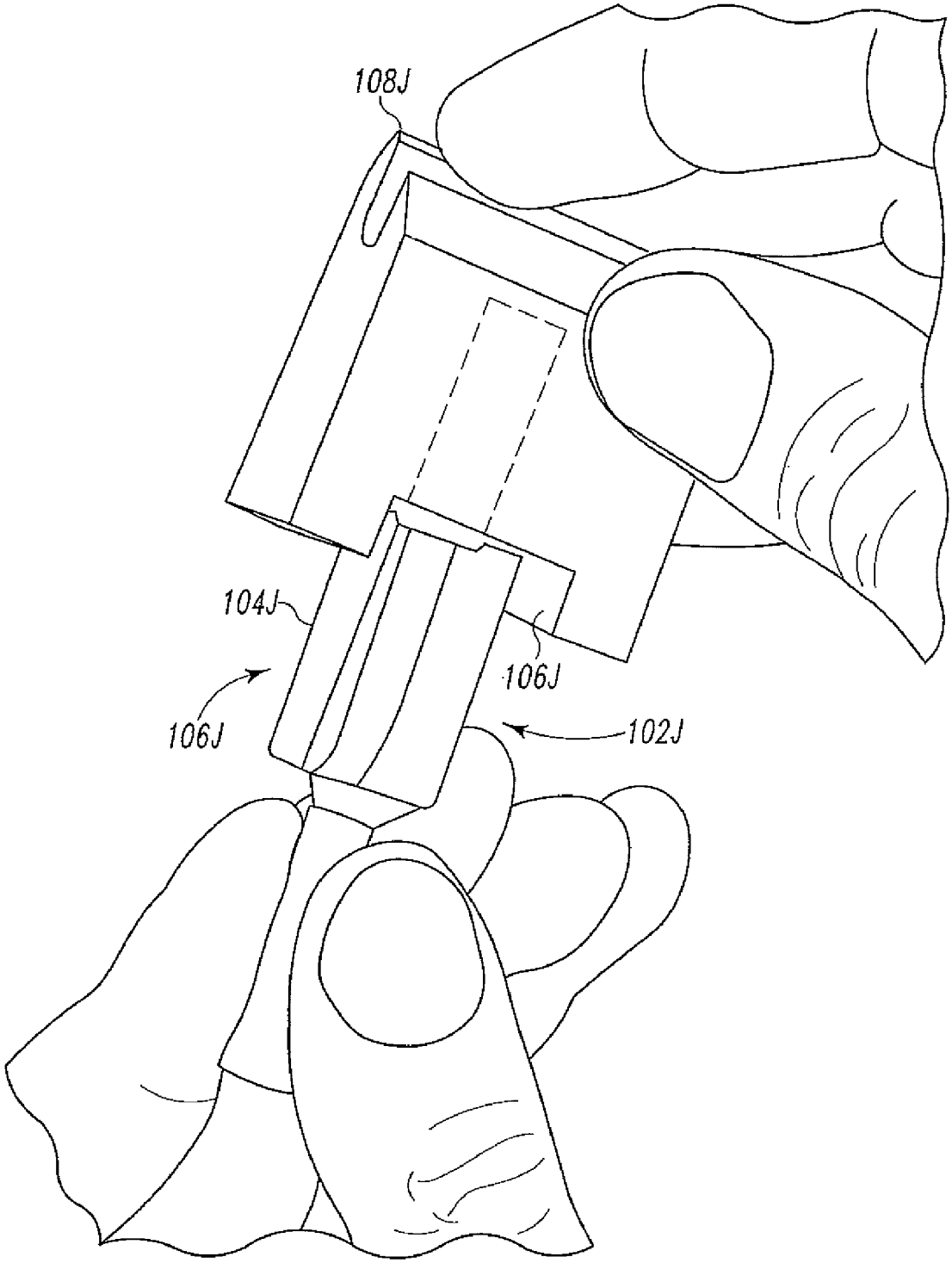
FIG. 7 is a front perspective view of an internal router bit of the router bit kit of FIG. 1 positioned in a bit holder of the router bit kit of FIG. 1.

Referring now to FIG. 7, the router bit 102J is shown with the router bit 102J removed from the bit holder 108J. The cutting surface 104J of the router bit 102J conforms to the three dimensional kerf profile portion 106J of the bit holder 108J.

Figure 8:
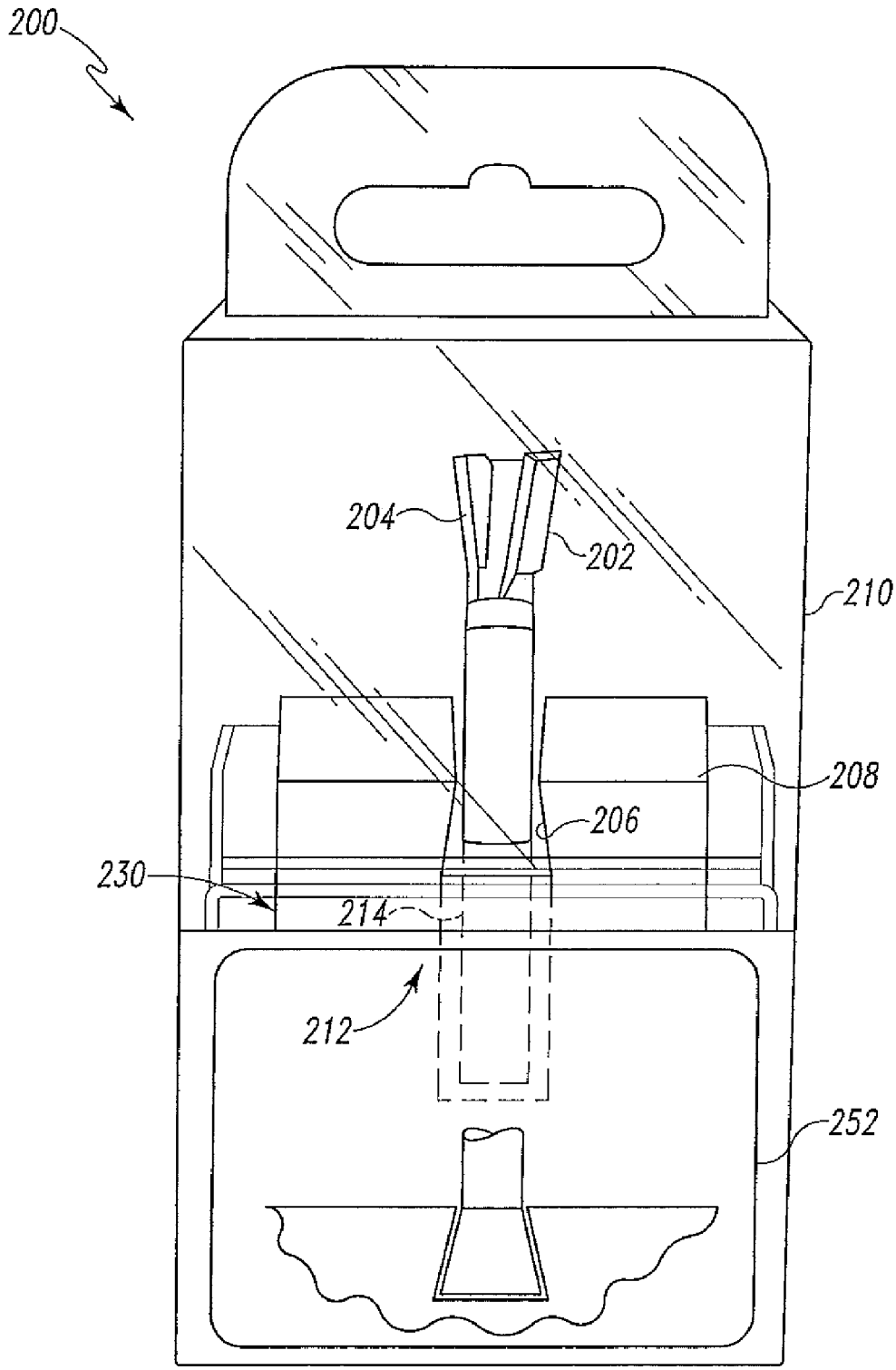
FIG. 8 is a front perspective view of another embodiment of the present disclosure in the form of a router bit kit including a router bit, a bit holder and a container.

Referring now to FIG. 8, yet another embodiment of the present disclosure is shown as router bit assembly 200. The router bit assembly 200 includes a router bit 202 having a cutting surface 204 configured to produce a cut having a three dimensional kerf profile. The router bit assembly 200 further includes a bit holder 208 having a three dimensional kerf profile portion 206 that matches the three dimensional kerf profile of the router bit 202. The router bit holder 208 includes a cavity 212 configured to receive at least a portion of the router bit 202.

For example and as shown in FIG. 8, the router bit 202 includes a stem 214 that extends from cutting surface 204 of the router bit 202. The cavity 212 is adapted to receive the stem 214. The stem 214 may be cylindrical and be received by the cylindrically shaped cavity 212 formed in the bit holder 208. The router bit assembly 200 further includes a container

210 for storing and protecting the router bit 202 and the bit holder 208. The container 210 may include a bit holder engaging portion 230. The bit holder 208 may be configured to cooperate with the bit holder engaging portion 230 of the container 210.

The bit holder engaging portion 230 may be a integral portion of the container 210 and may be molded. The bit holder 208 may be made of any suitable material. For example, the bit holder 208 may be made of polymer, synthetic rubber, or wood. The router bit 202 may be made of any suitable durable material and may be made of a carbide steel. The container 210 may be made of any suitable durable material and may be made of, for example, polymer, wood, cardboard, or metal The container 210 may be transparent to permit viewing of its contents including the router bit 202 and its holder 208 with its three dimensional kerf profile portion 206. The container 210 as shown includes a label 252 to describe of the contents of the container and may include the stem size. The label 252 shows the router bit 202 in use on a work piece.

The three dimensional kerf profile portion 206, as shown in FIG. 8, may be in the form of a groove in the holder 208. It should be appreciated that, when appropriate, the three dimensional kerf profile 206 may define an outer surface of the holder 208.

There is a plurality of advantages arising from the various features of each of the embodiments of the router bit kit described herein. It will be noted that alternative embodiments the router bit kit may not include all of the features described yet still benefit from at least some of the advantages of such features. Those of ordinary skill in the art may readily devise their own implementations of the router bit kit that incorporate one or more of the features described herein and fall within the spirit and scope of the present invention as defined herein.

What is claimed is:

1. A router bit kit, comprising:

a router bit having (i) a stem, and (ii) a cutting surface configured to produce a cut having a three dimensional kerf profile; and a bit holder having a body that includes a front surface, a back surface, a left side surface, a right side surface, a top surface, and a bottom surface, wherein said top surface defines an access opening, wherein said body further includes an interior wall surface extending downwardly from said access opening to define a cavity, wherein said cavity is (i) interposed between said front surface and said back surface, and (ii) interposed between said left side surface and said right side surface, wherein said three dimensional kerf profile is formed in at least one of the following: (i) said front surface, and (ii) said top surface, wherein said stem extends through said access opening and into said cavity, wherein said three dimensional kerf profile is formed in said top surface so as to define a three dimensional kerf profile structure, and wherein said cavity is interposed between (i) said three dimensional kerf profile structure, and (ii) said bottom surface.

2. The router bit kit of claim 1, further comprising:

a plurality of additional router bits having a plurality of additional stems; and a plurality of additional bit holders, wherein said plurality of additional bit holders are configured to respectively receive said plurality of additional stems therein.

3. The router bit kit of claim 2, further comprising a container configured to retain said router bit, said bit holder, said plurality of additional router bits, and said plurality of additional bit holders.

4. The router bit kit of claim 1, further comprising a container configured to retain said router bit and said bit holder.

5. The router bit kit of claim 4, wherein:

said container includes a bit holder engaging portion, and said bit holder is configured to cooperate with said bit holder engaging portion.

6. The router bit kit of claim 5, wherein:

said bit holder engaging portion comprises a dowel, said bottom surface defines a groove, and said dowel is received within said groove when said bit holder is retained within said container.

7. The router bit kit of claim 1, wherein said access opening is defined by said three dimensional kerf profile structure.

* * * * *